US007975760B2

(12) United States Patent
Tarnowski et al.

(10) Patent No.: US 7,975,760 B2
(45) Date of Patent: Jul. 12, 2011

(54) TOOL WRENCH ASSEMBLY

(75) Inventors: Bret A. Tarnowski, West Allis, WI (US); David T. Bienfang, Racine, WI (US)

(73) Assignee: Bucyrus International, Inc., South Milwaukee, WI (US)

( * ) Notice: Subject to any disclaimer, the term of this patent is extended or adjusted under 35 U.S.C. 154(b) by 289 days.

(21) Appl. No.: 12/366,995

(22) Filed: Feb. 6, 2009

(65) Prior Publication Data

US 2010/0200258 A1 Aug. 12, 2010

(51) Int. Cl.
*E21B 19/16* (2006.01)
*B25B 13/50* (2006.01)

(52) U.S. Cl. ..... 166/77.51; 81/57.33; 81/57.34

(58) Field of Classification Search ..... 166/77.51; 173/164; 81/57.33, 57.34
See application file for complete search history.

(56) References Cited

U.S. PATENT DOCUMENTS

| | | | | |
|---|---|---|---|---|
| 2,570,080 | A * | 10/1951 | Stone | 173/164 |
| 3,380,528 | A | 4/1968 | Timmons | |
| 3,434,543 | A | 3/1969 | Webb | |
| 3,832,918 | A | 9/1974 | Lang et al. | |
| 3,980,143 | A | 9/1976 | Swartz et al. | |
| 4,147,215 | A * | 4/1979 | Hodge et al. | 166/380 |
| 4,474,244 | A | 10/1984 | Beynet | |
| 4,595,066 | A | 6/1986 | Nelmark et al. | |
| 4,924,954 | A | 5/1990 | Mead | |
| 5,024,272 | A | 6/1991 | Roessler | |
| 5,584,342 | A | 12/1996 | Swinford | |
| 5,636,690 | A | 6/1997 | Garay | |
| 5,653,297 | A | 8/1997 | Whisenhunt | |
| 5,931,231 | A | 8/1999 | Mock | |
| 5,996,444 | A | 12/1999 | Pearce et al. | |
| 6,298,926 | B1 | 10/2001 | Dalkert et al. | |
| 6,510,908 | B2 | 1/2003 | Borgman | |
| 7,156,170 | B2 | 1/2007 | Fotland et al. | |
| 2003/0056989 | A1 | 3/2003 | Smith | |

* cited by examiner

*Primary Examiner* — Giovanna C Wright
(74) *Attorney, Agent, or Firm* — Foley & Lardner LLP

(57) ABSTRACT

A tool wrench assembly for a blasthole drill includes a fork pivotally fixed relative to at least one actuator that moves the fork between an engaged and a disengaged position.

18 Claims, 8 Drawing Sheets

TOOL WRENCH ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to a tool wrench assembly for joining and separating segments of a segmented drill pipe in a blasthole drill.

A drilling rig is conventionally used in surface mining and quarrying operations. Many of these rigs are mounted on a vehicle that travels on wheels or tractor crawlers to move the drilling rig to the desired drilling location. Once positioned, a rotary head drives a drill bit to begin the drilling operation.

However, it is impractical for these rigs to have a one-piece drill bit. As these rigs drill deep into the earth, the bit would need to be as long as the deepest possible drill depth. At these lengths, it would be difficult to transport the bits and would require undesirably large masts for support. Moreover, the tip of the drill dulls during use, requiring frequent replacement. It is much more cost effective to replace only the drill tip portion of the drill bit on an as-needed basis.

Hence, most drilling rigs have segmented drill pipe strings. These drill pipe strings include multiple drill pipe segments that are attached together at screw threads. At the lowermost end of the pipe string, the drill bit is attached.

During joining or separation of the drill pipe segments, one of the segments must be held in place while an adjacent segment is rotated to thread or unthread the segments from one another. Typically, a tool wrench engages the flats on the lower segment or otherwise grips it to prevent it from rotating. See e.g., U.S. Pat. Nos. 3,980,143; 5,931,231; 5,996,444; and 6,298,926. See also, U.S. patent publication 2003/0056989. The tool wrench is extended to engage the flats as necessary and is then removed before the drill pipe string is again raised or lowered. The tool wrench may also temporarily support the weight of the drill pipe string when the drill pipe string is not directly attached to the rotary head.

However, particularly during the lifting or withdrawal of the drill pipe segments, an operator may forget to disengage the tool wrench from the flats of the drill pipe segment. This can potentially damage the tool wrench, the components that actuate the tool wrench, and/or the rotary head to which the drill pipe string is attached.

Hence, there is a need for an improved tool wrench assembly. In particular, there is a need for a drilling rig with a tool wrench assembly that is less prone to damage as a result of the inadvertent raising of the pipe string.

SUMMARY OF THE INVENTION

A tool wrench assembly is disclosed. The tool wrench assembly includes a base, a first actuator fixed to the base, and a second actuator fixed to the base. The second actuator is spaced from and is parallel to the first actuator. A fork is pivotally fixed relative to, and extends between, the first actuator and the second actuator. The first actuator and the second actuator move the fork relative to the base upon actuation of the first actuator and the second actuator.

Thus, a tool wrench assembly is provided with a fork that flips up to disengage the fork from the flats of the drill pipe when the drill pipe is lifted without first disengaging the fork by movement of the actuators. Further, the tool wrench assembly has a structure that provides for the fork to engage the flats of drill pipe segments when the actuators (such as, for example, hydraulic cylinders) are moved into a retracted position. In a retracted position, the actuators are less prone to bending damage resulting from inadvertent lifting. These features, as well as others that will be described below, make the tool wrench assembly less susceptible to damage than other tool wrench assemblies.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Figure 1:
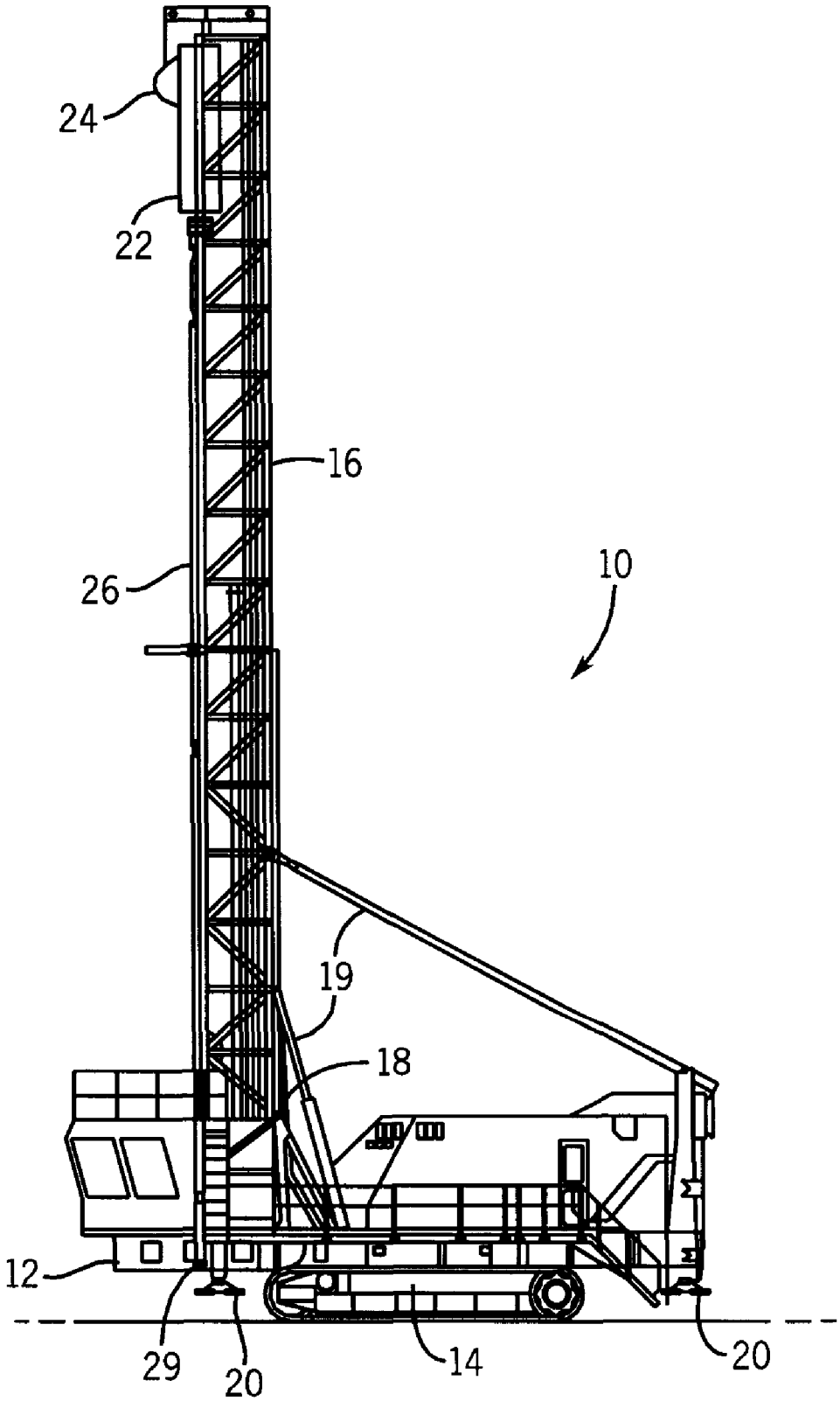
FIG. 1 is a side plan view of a blasthole drill.
Figure 2:
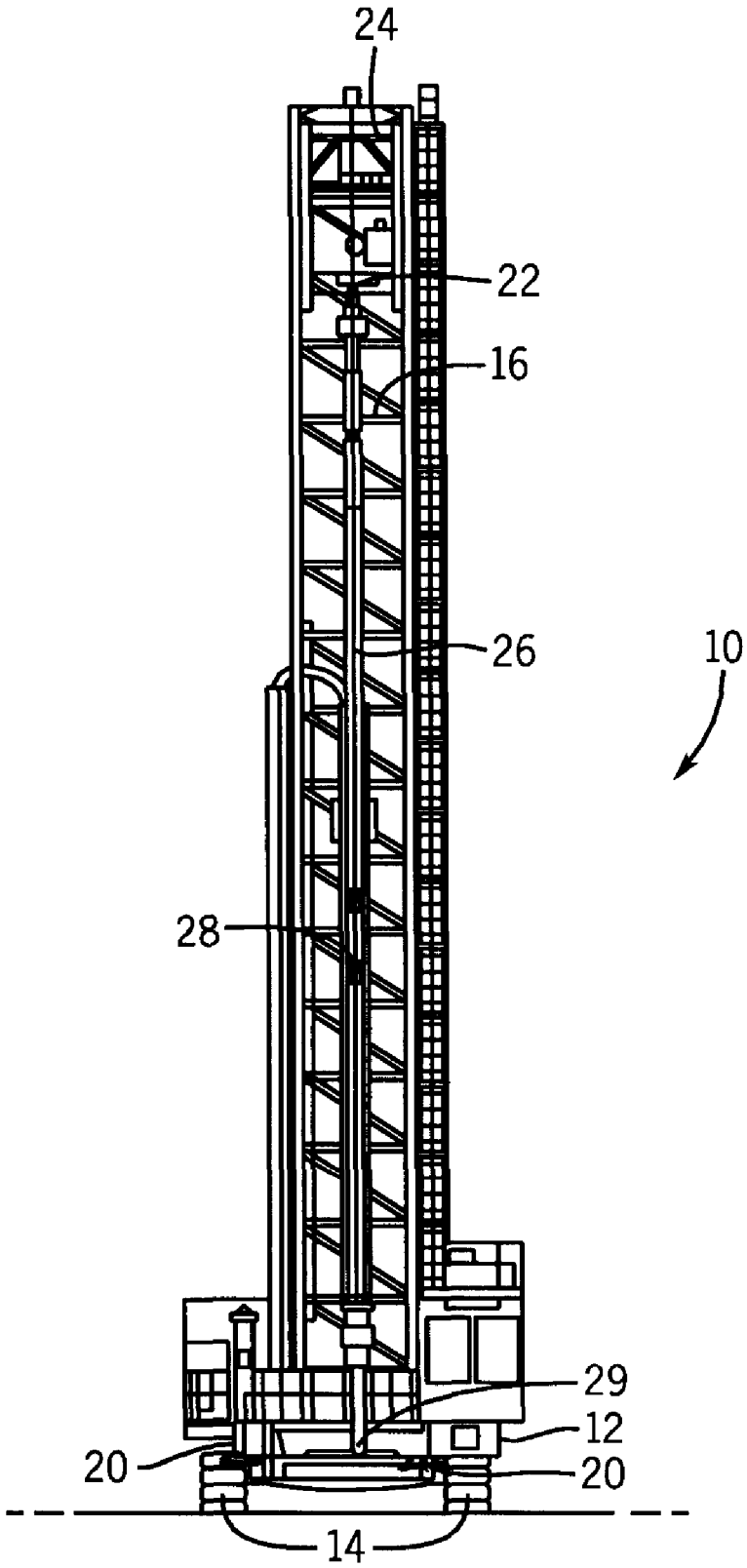
FIG. 2 is a front plan view of the blasthole drill of FIG. 1.
Figure 3:
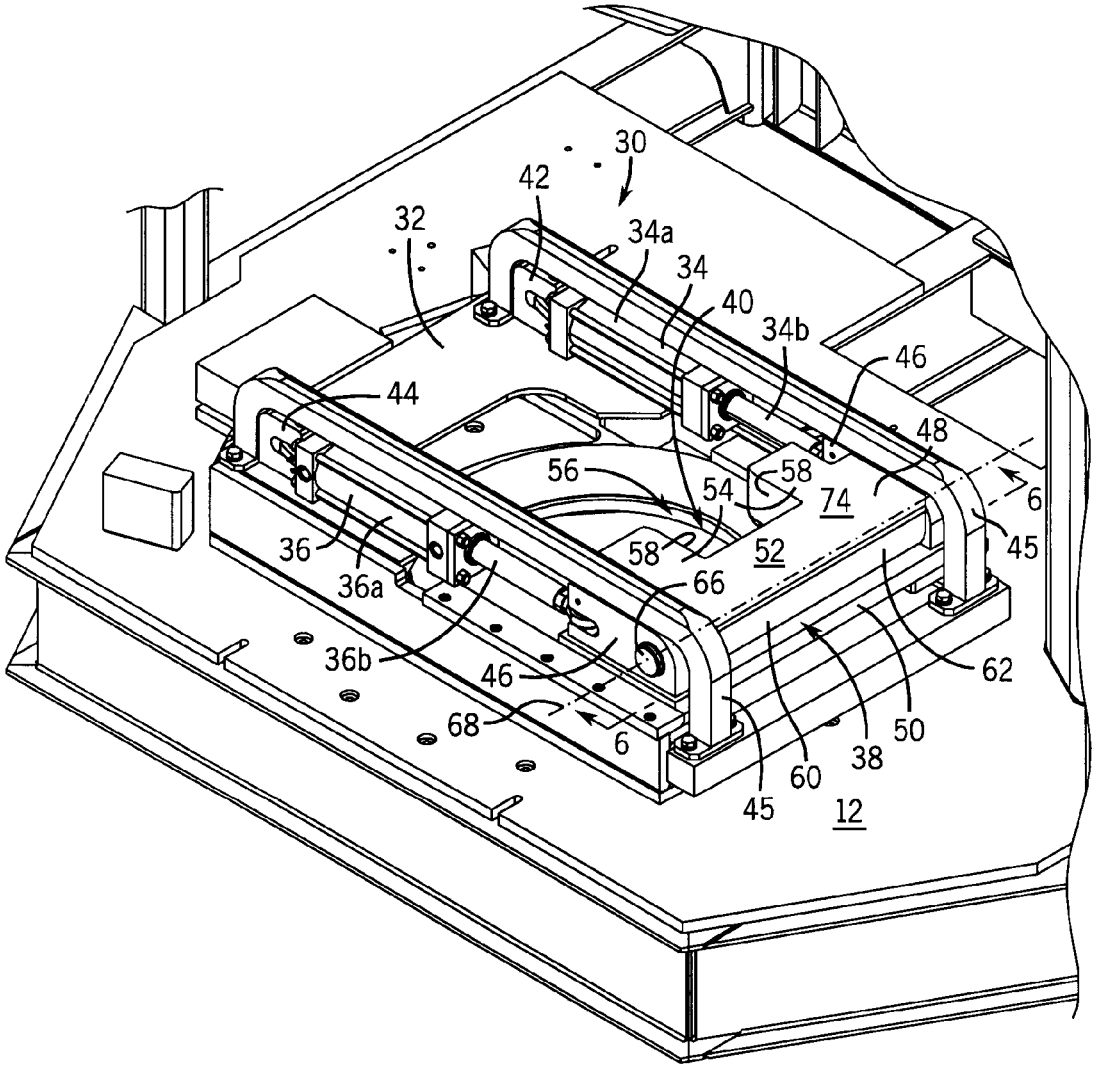
FIG. 3 is a perspective view of the tool wrench assembly in an extended position.
Figure 4:
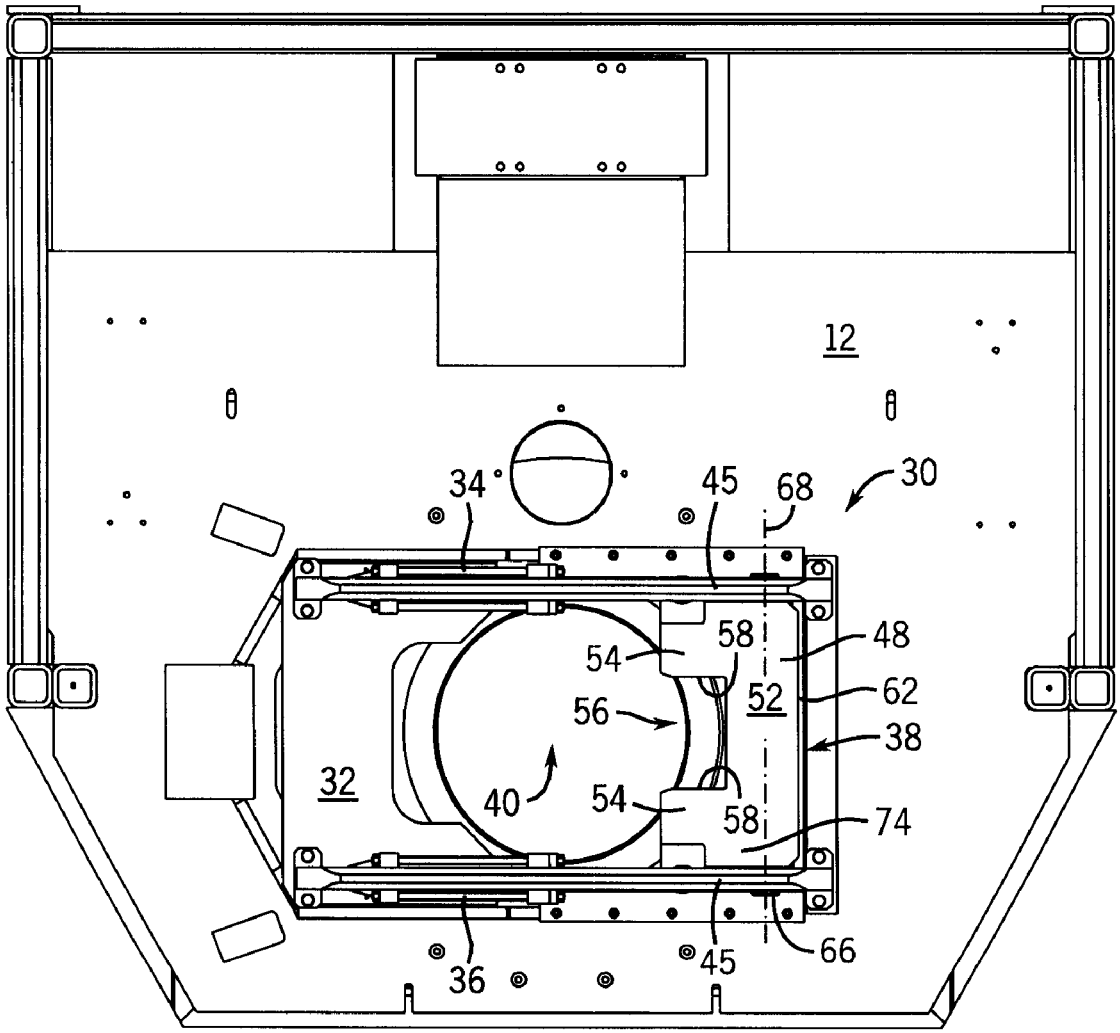
FIG. 4 is a top plan view of FIG. 3.
Figure 5:
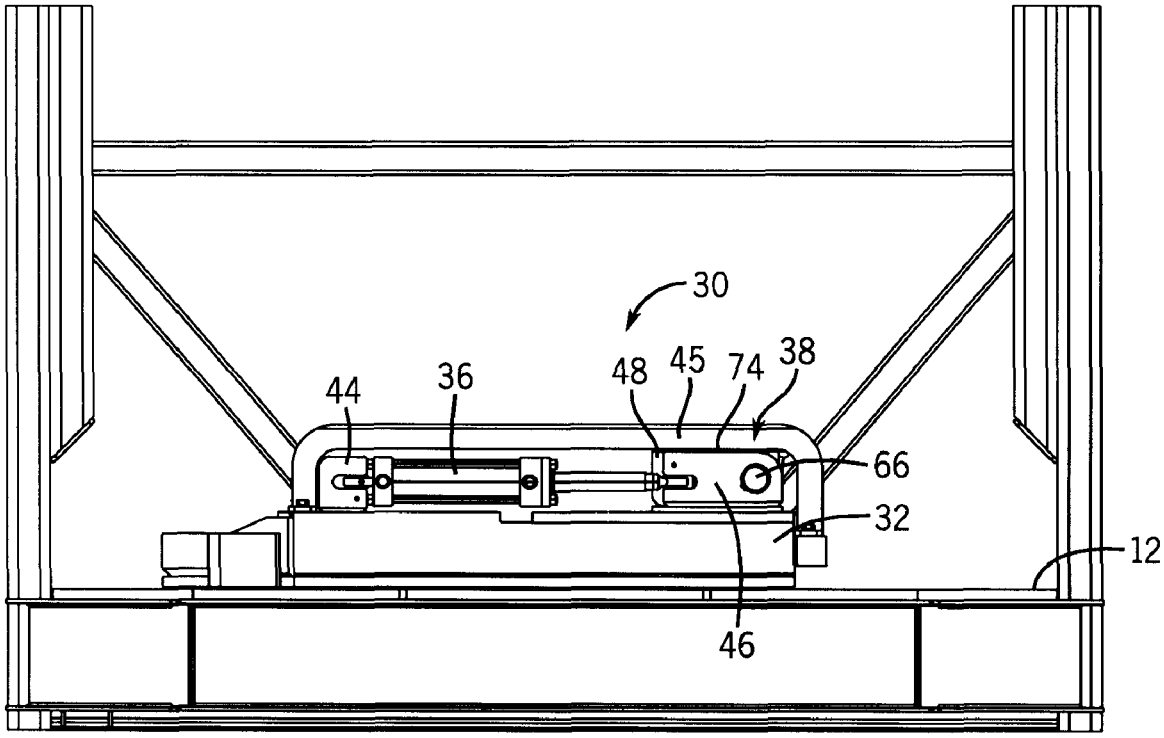
FIG. 5 is a front plan view of FIG. 3.
Figure 6:
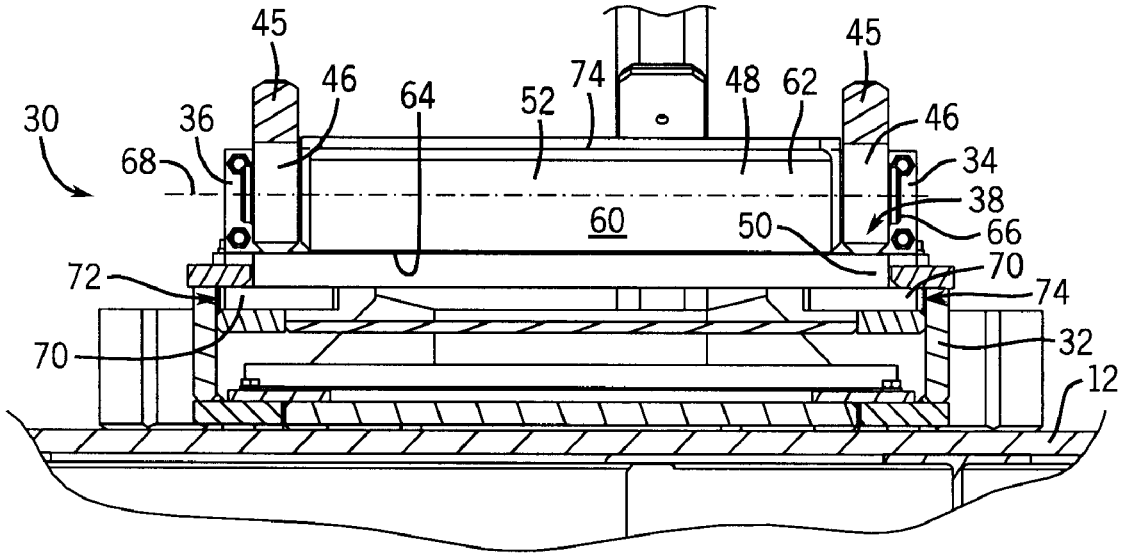
FIG. 6 is a cross-sectional side view of the tool wrench taken along line 6-6.
Figure 7:
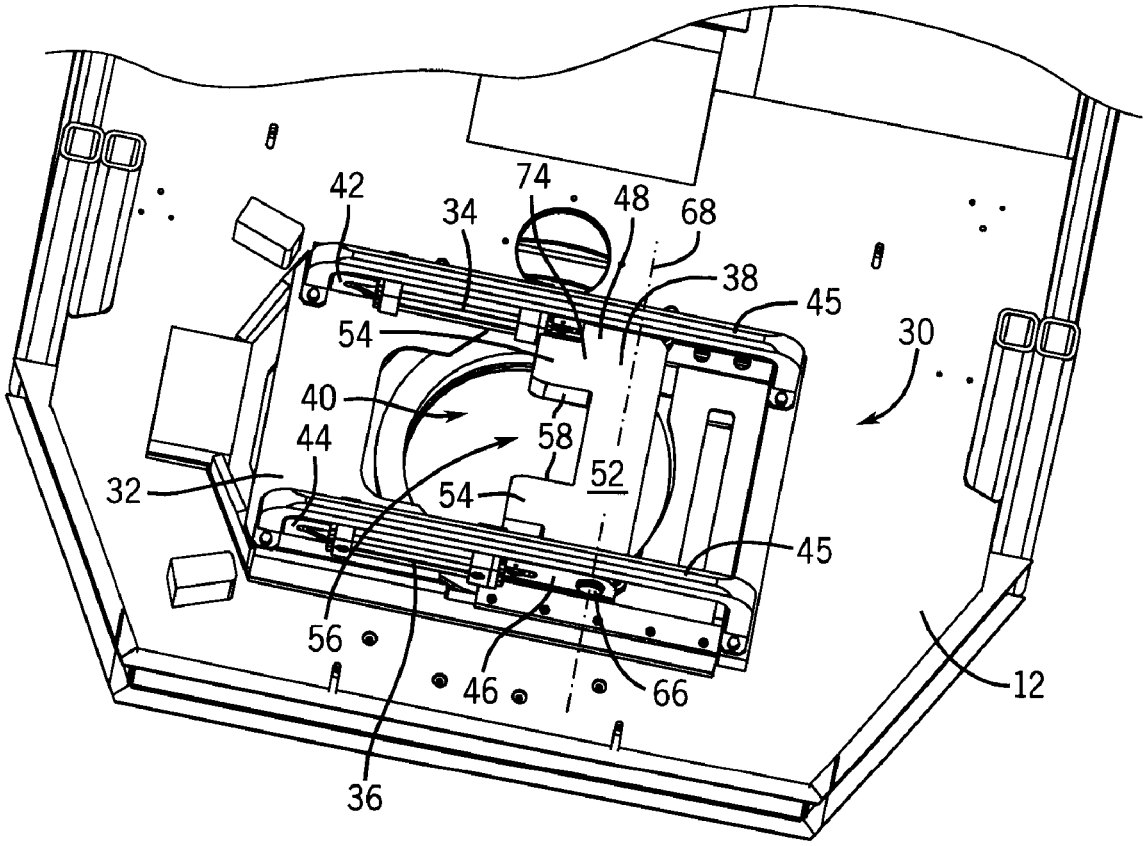
FIG. 7 is a perspective view of the tool wrench assembly in a retracted position.

Referring first to FIGS. 1 and 2, a blasthole drill 10 is illustrated, such as a Bucyrus Series 49 Blasthole Drill available from Bucyrus International, Inc. in South Milwaukee, Wis. The blasthole drill 10 includes a main deck frame 12 supported on crawler tractors 14. Attached to the main deck frame 12 is a mast 16 supported in a pivot 18. A number of adjustable supports 19 set the angle of the mast 16 relative to the main deck frame 12. A set of jacks 20 are also attached to the main deck frame 12 for stabilizing the blasthole drill 10 during a drilling operation.

The mast 16 supports many of the drilling components. On the top of the mast 16, a rotary drill head 22 is mounted to a pull-down mechanism 24. The pull-down mechanism 24 travels up and down the side cords of the mast 16 on a rack of teeth. The rotary drill head 22 includes a rotary drive which engages the top of a drill pipe string 26. A drill pipe magazine 28 contains storage for drill pipe segments that can be added to or removed from the drill pipe string 26. At the lower end of the drill pipe string 26, a drill bit 29 is attached to the bottom segment of the drill pipe string 26.

Referring now to FIGS. 3-8, further detail of the main deck frame 12 according to one embodiment of the present invention is shown. A tool wrench assembly 30 is mounted on the main deck frame 12. The tool wrench assembly 30 includes a base 32, a first hydraulic cylinder 34, a second hydraulic cylinder 36, and a fork carriage 38.

The base 32 (and any underlying portion of the main deck frame 12) has a hole 40 extending there through. Although not shown in FIGS. 3-8, the drill pipe string 26 typically extends through the hole 40. Thus, the hole 40 should be sufficiently large for any portion of the drill pipe string 26 or the drill bit 29 to pass through. Moreover, as the mast 16 may be pivoted for drilling operations at an angle, the size and/or shape of the hole 40 should accommodate for these drilling angles.

It should be appreciated that although the hole 40 is shown in the base 32 and main deck frame 12, that a U-shaped cutout or other non-closed form could likewise provide the necessary path for the drill pipe string 26 or drill bit 29.

The components of the tool wrench assembly 30 are placed around the hole 40. The first hydraulic cylinder 34 and the second hydraulic cylinder 36 are attached to the base 32 on opposing sides of the hole 40. In particular, the first cylinder 34 and the second cylinder 36 are linked to the base 32 at a first bracket 42 and a second bracket 44, respectively. The first and second brackets 42 and 44 may be integrally formed with the base 32 or may be attached to the base 32. A pair of rails 45 extend over the brackets 42 and 44, the cylinders 34 and 36, and a portion of the fork carriage 38 to vertically restrain these components.

Generally speaking, each of the cylinders 34 and 36 have a body with an actuating piston that extends there from. In the embodiment shown, the body ends 34*a* and 36*a* of the each of the cylinders 34 and 36 are pivotally attached to the brackets 42 and 44 about vertical pivot axes. The piston ends 34*b* and 36*b* of each of the cylinders 34 and 36 connects to the fork carriage 38 to move the fork carriage 38 between an extended position and a retracted position.

The fork carriage 38 includes a fork 48 pivotally connected to a slidable carriage plate assembly 50. The fork 48 is interposed between a pair of end plates 46 fixed to the slidable carriage plate assembly 50. Each of the pair of end plates 46 is connected to one of the piston ends 34*b* and 36*b* to connect the fork carriage 38 to the cylinders 34 and 36. As shown, the connection between the cylinders 34 and 36 the brackets 42 and 44 and the cylinders 34 and 36 and the pair of end plates 46 are pivotally hinged to allow for some tolerance in the positioning of the cylinders 34 and 36 as the fork carriage 38 moves.

The fork 48 is shaped to engage the flats of a drill pipe segment or the drill bit 29. The fork 48 has a body 52 with two prongs 54 extending forwardly therefrom to provide a generally U-shaped engagement recess 56. The two prongs 54 are essentially parallel to one another and likewise form two flats 58 that are essentially parallel with one another. The back side of the fork 48 has a curved portion 60 formed between a rear face 62 and a bottom face 64 of the fork 48.

The pair of end plates 46 are positioned on the lateral sides of the fork 48 such that the fork 48 extends between the first hydraulic cylinder 34 and the second hydraulic cylinder 36. A shaft 66 runs through the pair of end plates 46 and the fork 48 and pivotally fixes the fork 48 relative to the first hydraulic cylinder 34 and the second hydraulic cylinder 36. The shaft 66 defines a pivot axis 68 about which the fork 48 pivots.

The pair of end plates 46 are also linked to the slidable carriage plate assembly 50. The slidable carriage plate assembly 50 has outwardly extending guides 70 on either side that are received in and travel along pair of slots 72 formed in the base 32. The outwardly extending guides 70 vertically restrain the slidable carriage plate assembly 50 against the vertical forces exerted on the fork 48 during operation.

During operation, the tool wrench assembly 30 can be actuated between the extended position (shown in FIGS. 3-6) and the retracted position (shown in FIGS. 7 and 8) using the hydraulic cylinders 34 and 36. During extension or retraction, the outwardly extending guides 70 of the slidable carriage plate assembly 50 traverse the pair of slots 72 formed in the base 32. In the extended position, the first hydraulic cylinder 34 and the second hydraulic cylinder 36 are extended to place the fork carriage 38 away from the hole 40 and/or the drill pipe segment extending there through. In the retracted position, the first hydraulic cylinder 34 and the second hydraulic cylinder 36 are retracted to draw the fork carriage 38 over the hole 40 such that the flats 58 of the fork 48 engage the flats of a drill pipe segment or a drill bit. At this point, the rotary drill head 22 can rotate one of the segments to join or disconnect a segment to or from the drill pipe string 26, while the fork 48 holds the adjacent segment stationary.

As the dual hydraulic cylinders 34 and 36 are in a retracted position when the fork 48 engages the drill pipe segment, the tool wrench assembly 30 is less prone to damage from the applied torque. Given the spatial arrangement of the components of the tool wrench assembly 30, when the fork 48 is drawn into engagement with the pipe segment, the dual hydraulic cylinders 34 and 36 are retracted. In the retracted position, the cylinders 34 and 36 are less susceptible to bending, tensile failure or the like as the piston is secured in the body.

Figure 8:
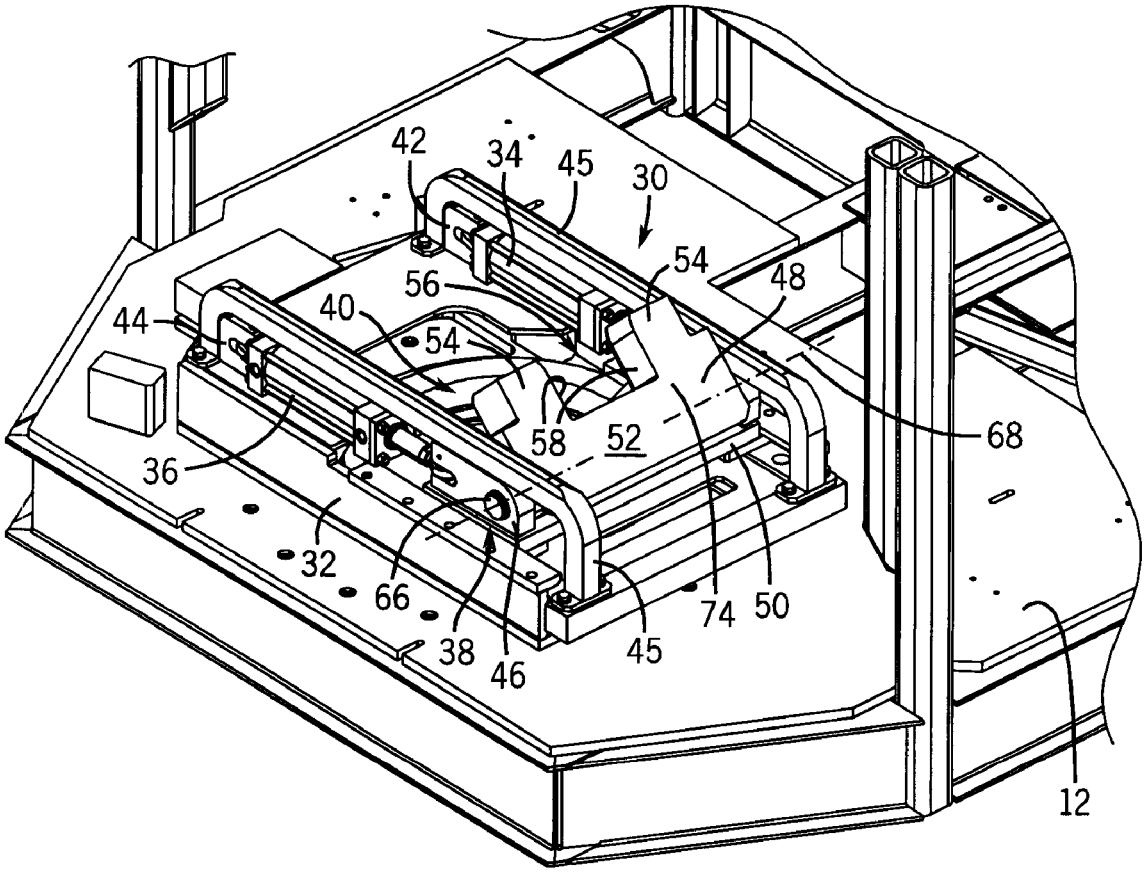
FIG. 8 is a perspective view of the tool wrench assembly in the retracted position in which the fork has been flipped up.

Although the fork 48 is usually in an essentially horizontal position, it can flip up to a position that deviates from the essentially horizontal position as shown in FIG. 8. The curved portion 60 of the fork 48 provides sufficient clearance for the fork 48 to rotate or flip upward about pivot axis 68.

This flip-up action may be desirable, for example, when withdrawing the drill pipe string 26 from the ground. As each of the segments are unthreaded from one another, the fork 48 will temporarily support an unattached drill pipe string on the top face 74 of the fork 48 until the rotary drill head 22 is rethreaded to the pipe string. Once the rotary drill head 22 is attached to the pipe string, the string is again withdrawn. Although the operator typically removes the fork 48 from engagement with the flats of the segment before continuing to lift the drill pipe string 26, sometimes this step is forgotten. In the event that the fork 48 is not disengaged from the segment, the fork 48 can pivotally flip up to disengage the flats 58 of the fork 48 from the flats of the segment. In this way, the segment is freed from the fork 48, even thought the hydraulic cylinders 34 and 36 have not been actuated to disengage the fork 48 from the segment.

The tool wrench assembly 30 may be a component that is installed into a main deck frame 12 or the tool wrench assembly 30 could use the main deck frame 12 as the base. If the tool wrench assembly 30 is a separate component, then it may be secured to the main deck frame 12 by the bolting the tool wrench assembly 30 to the base 32 by inserting bolts into bolt holes in the base 32. The base 32 could also be welded or joined in some other way to the main deck frame 12.

It should be appreciated that the although the embodiment shown uses two hydraulic cylinders 34 and 36, that any actuator or actuation mechanism could be used in their place.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A tool wrench assembly comprising:

a base;

a first actuator fixed to the base;

a second actuator fixed to the base, the second actuator being spaced from and parallel to the first actuator; and a fork pivotally fixed relative to and extending between the first actuator and the second actuator, wherein the first actuator and the second actuator move the fork relative to the base upon actuation of the first actuator and the second actuator, and wherein the fork is pivotally movable between an essentially horizontal orientation and an orientation that deviates from the essentially horizontal position.

2. The tool wrench assembly as in claim 1, including a fork plate extending between the first actuator and the second actuator, the fork being pivotally fixed relative to the fork plate, wherein the first actuator and the second actuator move the fork plate and the fork relative to the base upon actuation of the first actuator and the second actuator.

3. The tool wrench assembly as in claim 1, wherein the first actuator and the second actuator are each a hydraulic cylinder.

4. The tool wrench assembly as in claim 3, wherein when the first actuator and the second actuator are moved from an extended to a refracted position, the first actuator and the second actuator draw the fork over a hole in the base.

5. The tool wrench assembly as in claim 4, wherein the first actuator and the second actuator are fully retracted in the retracted position.

6. The tool wrench assembly as in claim 4, wherein, in the extended position, the fork is essentially cleared from a position over the hole in the base.

7. The tool wrench assembly as in claim 1, wherein the base includes mounting holes for securing the base to a deck.

8. The tool wrench assembly as in claim 1, wherein the fork includes a body with two prongs extending therefrom, each of the two prongs having a flat formed thereon.

9. The tool wrench assembly as in claim 8, wherein the flat formed on one of the two prongs is parallel to the flat formed on the other of the two prongs.

10. A blasthole drill, comprising a tool wrench assembly comprising a base; a first actuator fixed to the base; a second actuator fixed to the base, the second actuator being spaced from and parallel to the first actuator; and a fork pivotally fixed relative to and extending between the first actuator and the second actuator, wherein the first actuator and the second actuator move the fork relative to the base upon actuation of the first actuator and the second actuator, and wherein the fork is pivotally movable between an essentially horizontal orientation and an orientation that deviates from the essentially horizontal position.

11. A tool wrench assembly for joining and separating a drill pipe string having a plurality of segments, the tool wrench assembly comprising:

a fork carriage movable between an engaged position in which a fork pivotally fixed to the fork carriage engages one of the plurality of segments and a disengaged position in which the fork carriage keeps the fork out of engagement with any of the plurality of segments;

at least one actuator for moving the fork carriage between the engaged position and the disengaged position; and a base having slots, wherein the fork carriage includes a slidable carriage plate assembly having guides that engage the slots of the base to restrain the fork carriage.

12. The tool wrench assembly of claim 11, wherein the fork pivotally mounted to the fork carriage has a pivot axis that is essentially horizontal.

13. The tool wrench assembly of claim 11, wherein the at least one actuator is a hydraulic cylinder.

14. The tool wrench assembly of claim 13, wherein the hydraulic cylinder is refracted in the engaged position.

15. A tool wrench assembly for joining and separating a drill pipe string having a plurality of segments, the tool wrench assembly comprising:

a fork carriage movable between an engaged position in which a fork pivotally fixed to the fork carriage engages one of the plurality of segments and a disengaged position in which the fork carriage keeps the fork out of engagement with any of the plurality of segments, wherein the fork pivotally mounted to the fork carriage has a pivot axis that is essentially horizontal; and at least one actuator for moving the fork carriage between the engaged position and the disengaged position.

16. The tool wrench assembly of claim 15, further comprising a base having slots, wherein the fork carriage includes a slidable carriage plate assembly having guides that engage the slots of the base to restrain the fork carriage.

17. The tool wrench assembly of claim 15, wherein the at least one actuator is a hydraulic cylinder.

18. The tool wrench assembly of claim 17, wherein the hydraulic cylinder is retracted in the engaged position.

* * * * *